US007189115B1

(12) United States Patent
Montena

(10) Patent No.: US 7,189,115 B1
(45) Date of Patent: Mar. 13, 2007

(54) CONNECTOR FOR SPIRAL CORRUGATED COAXIAL CABLE AND METHOD OF USE THEREOF

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/322,097

(22) Filed: Dec. 29, 2005

(51) Int. Cl.
*H01R 9/05* (2006.01)

(52) U.S. Cl. ..... 439/584

(58) Field of Classification Search ..... 439/578, 439/583, 584
See application file for complete search history.

(56) References Cited

U.S. PATENT DOCUMENTS 3,764,959 A 10/1973 Toma et al.
3,910,673 A 10/1975 Stokes
5,267,877 A * 12/1993 Scannelli et al. ..... 439/584
5,322,454 A 6/1994 Thommen
5,435,745 A 7/1995 Booth
5,766,037 A 6/1998 Nelson
5,863,220 A 1/1999 Holliday
6,032,358 A 3/2000 Wild
6,109,964 A 8/2000 Kooiman
6,267,621 B1 7/2001 Pitschi et al.
6,309,251 B1 10/2001 Tang
6,471,545 B1 10/2002 Hosler, Sr.
6,884,113 B1 4/2005 Montena

* cited by examiner

*Primary Examiner*—Tho D. Ta
(74) *Attorney, Agent, or Firm*—Schmeiser, Olsen & Watts

(57) ABSTRACT

A connector for coupling an end of a coaxial cable, the coaxial cable having a center conductor surrounded by a dielectric, the dielectric being surrounded by a spiral corrugated thin-walled conductor. The connector includes a connector body, a fastener member including a central passageway has a grooved surface dimensioned for closely receiving the spiral corrugated thin-walled conductor. The central passageway compresses inwardly to decrease the volume of the central passageway when moved toward the second end of the connector body causing a minor distortion of the spiral corrugated thin-walled conductor of the coaxial cable as said fastener member is advanced over the connector body toward the second end of said connector body.

20 Claims, 4 Drawing Sheets

CONNECTOR FOR SPIRAL CORRUGATED COAXIAL CABLE AND METHOD OF USE THEREOF

BACKGROUND OF INVENTION

1. Technical Field

This invention relates generally to the field of connectors for use with spiral corrugated coaxial cable. More particularly, this invention provides for a connector for use with a spiral corrugated coaxial cable with a fastener member that compresses onto the corrugation of the coaxial cable.

2. Related Art

Heretofore, connectors for use with spiral corrugated coaxial cable have had difficulty with proper electrical mechanical contacts of the corrugated outer conductor by pinching it against a stubby annular ridge. The ridge fits just within the inner diameter of the outer conductor and pushes against lateral surfaces of the cable corrugations in the axial direction. Because the corrugations are formed in a continuous spiral, the push element of the connector is typically formed with a mating spiral within it.

Two problems arise from this method of clamping. First, a stubby ridge makes imperfect contact with the cut edge of the spiral outer conductor. Second, lateral surfaces of the corrugation are relatively weak, being formed of thin copper, and are particularly unsuited to withstand constant force in the axial direction, which direction of force is necessary to keep the cable fitted firmly against the stubby ridge. Weakening of this contact with the outer conductor over time can result in poor shielding and unacceptable levels of passive inter modulation.

Accordingly, there is a need in the field of connectors for use with spiral corrugated coaxial cable for an improved connector.

SUMMARY OF INVENTION

The present invention provides a connector that uses uniform, supportive radial contact with the outer surface of the corrugations.

A first general aspect of the invention provides a connector for coupling an end of a coaxial cable, the coaxial cable having a center conductor surrounded by a dielectric, the dielectric being surrounded by a spiral corrugated thin-walled conductor, said connector comprising: a connector body, having a first end and a second opposing end; a fastener member, axially positioned proximate the first end of the connector body, said fastener member having a central passageway, said central passageway having a grooved surface dimensioned for closely receiving the spiral corrugated thin-walled conductor; and a compression member, wherein axial advancement of the compression member toward the second end of said connector body compresses the central passageway of the fastener member inwardly causing the fastener member to engage the spiral corrugated thin-walled conductor of the coaxial cable.

A second general aspect of the invention provides a connector for use with coaxial cable having spiral corrugated conductor, the connector comprising: a connector body, having a first end and a second end; a compression cap configured to axially slidably engage the first end of the connector body; and a clamp received between the connector body and the compression cap, wherein the clamp includes: an internal spiral complimentary to the spiral corrugated conductor of the coaxial cable, wherein, axial advancement of the compression cap onto the connector body facilitates secure contact between the clamp and the spiral corrugated conductor of the coaxial cable.

A third general aspect of the present invention provides a method of attaching a connector to a spiral corrugated coaxial cable; the method comprising: inserting a coaxial cable with spiral corrugation into a connector; threading a clamp of the connector onto the corrugation of the coaxial cable; compressing a compression cap of the connector onto a connector body of the connector; and deforming the clamp uniformly and radially inward to electrically contact an outer surface of the corrugation.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figures 1, 2:
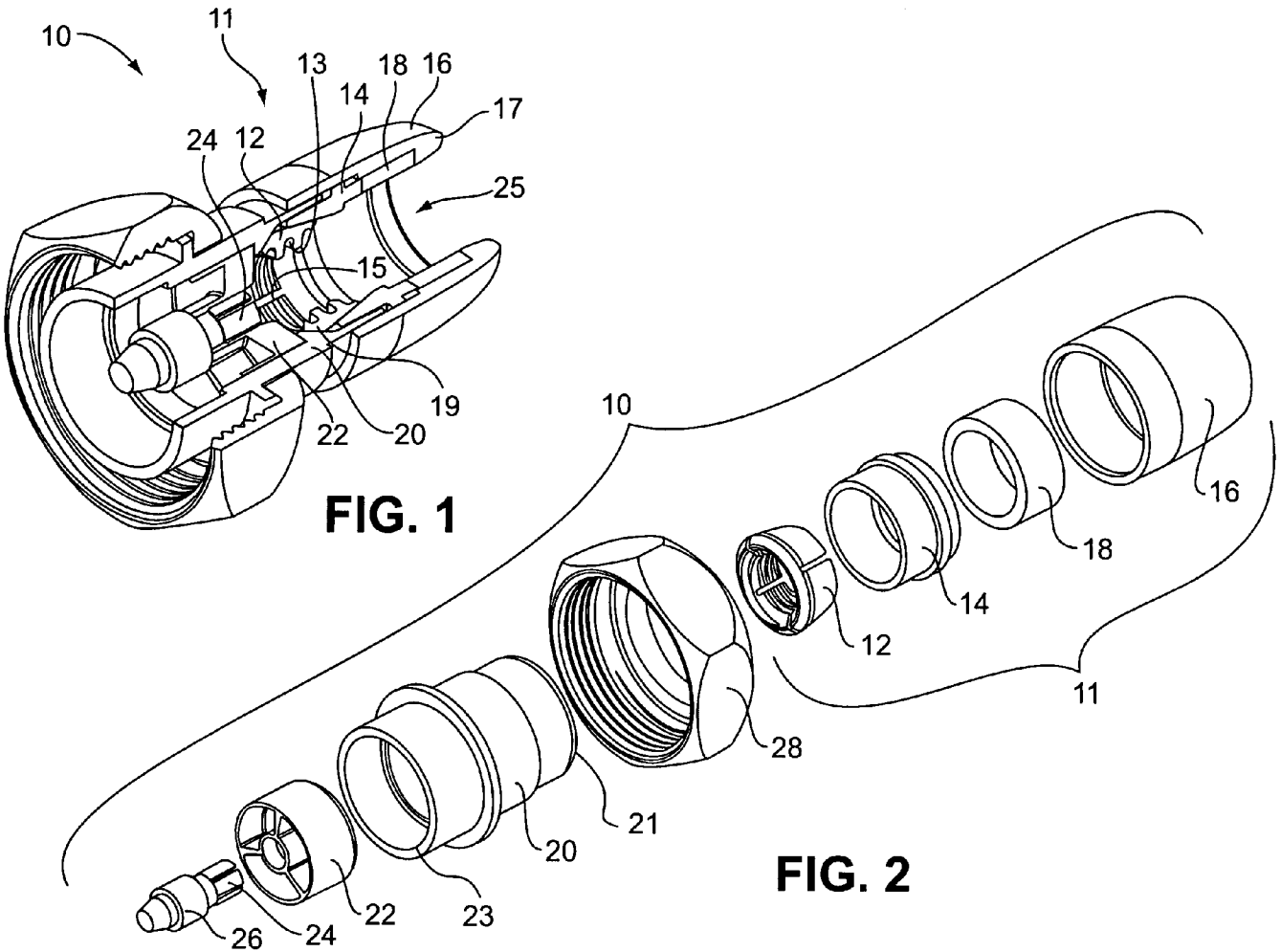
FIG. 1 depicts a perspective view with a partial section of an embodiment of a connector, in accordance with the present invention.
FIG. 2 depicts an exploded view of the embodiment of the connector of FIG. 1, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

Referring to the drawings, FIG. 1 depicts one embodiment of a connector 10. The connector 10 may include a fastener 11, wherein the fastener 11 may include a fastener member 12, a compression member 14, a cap 16, an elastomeric grommet 18. The connector 10 may further include a connector body 20, an insulator 22 and a center conductor contact 24. The connector body 20 may be configured to receive the cap 16. The fastener member 12, of the fastener 11, may be received between the connector body 20 and the cap 16. Further the compression member 14 may be received between the connector body 20 and the cap 16, adjacent to the fastener member 12. At least one of the fastener member 12 and the compression member 14 may be a frustoconical shape and engage the other of the compression member 14 and the fastener member 12. When one of the fastener member 12 or the compression member 14 engages the other, the fastener member 12 is moveable and/or deformable from an open position to a clamped position.

Referring further to the FIG. 1, the fastener member 12 may comprise a grooved surface 13 complimentary to a spiral configuration of a spiral corrugated coaxial cable and at least one slot 15, wherein the slot 15 may allow the fastener move 12 to move, compress and/or deform radially. The elastomeric seal 18 may be received between the cap 16 and the compression member 14. According to particular embodiments of the present invention, the elastomeric seal 18 may be configured to expand radially while being compressed axially. The seal 18 may be configured to seal the connector 10 to substantially prevent moisture entry into the connector, provide additional grip on the coaxial cable, and/or provide strain relief to the connector 10.

With additional reference to FIG. 1, the fit between the connector body 20 and the cap 16 may be a sliding press fit. The fit between the fastener member 12 and the compression member 14 may be a sliding tapered ramp fit. The fit between the connector body 20 and the fastener member 12 may be a sliding ramped press fit. The fit between the cap 16 and the compression member 14 may be a partially sliding clearance while making contact with at least one of the seal 18 and the cap 16 on an end of the seal and the compression member 14. It will be understood by those of ordinary skill in the art that these fitting types are not a limitation to the scope of the invention and that other fitting types such as but not limited to a threaded fitting between components may be employed.

With additional reference to the drawings, FIG. 2 depicts an exploded view of an embodiment of a connector 10 according to FIG. 1. The connector 10 may comprise a fastener 11, which may include a fastener member 12, a compression member 14, a cap 16 and an elastomeric seal 18. The connector 10 may also include a connector body 20, an insulator 22, a center conductor contact 24, a DIN pin 26 and a DIN nut 28. The insulator 22 may be configured to insulate the center conductor contact 24 from the connector body 20 and against extraneous environmental conditions. This configuration may provide insulation between an inner conductor and an outer conductor of a spiral corrugated coaxial cable, wherein the center conductor contact 24 receives an inner conductor of a coaxial cable and the fastener member 12 receives an outer conductor of a coaxial cable. The connection between the fastener member 12 and an outer conductor of a coaxial cable may be translated to the connector body 20 through physical and/or electrical contact between the fastener member 12 and the connector body 20. This insulation may allow for proper functionality of the cable and the connector 10. The DIN pin 26 may be a standard male interface for an auxiliary unit (not shown). The DIN nut 28 may be coupled to the connector body 20 such that the nut 28 may be rotated so as to couple the connector 10 to the auxiliary unit. It will be understood by those of ordinary skill in the art that the connector is not limited in scope to the use of a DIN pin 26 and a DIN nut 28, but that the connector 10 may be configured for any type of connection interface. These various types of connectors may include, without limitation, a female DIN, a male and female TNC, a male and female N, a male and female F, a male and female HN, a male and female LC, a male and female LT, a male and female SMA, a male and female UHF and any other type of connection interface.

It will be understood that the fastener member 12 may be any type of fastener element such as, but not limited to a collar, a squeeze bushing, an adapter, a bond, a clamp, a coupling, a joint, a junction, a link, a tie, a bar, a key, a latch, a lock, a nut, a peg, a pin, a rivet, a rod, a screw and a sliding bar. The compression member 14 may be any type of member that applies a compressing force upon the fastener member 12, such as, but not limited to, a ramp, a nut, a collar, a wedge, a frustoconical member, an inclined and/or declined plane and any other member that may translate an axial movement to a radial force. The seal 18 may be any type of seal, including, and without limitation, a grommet, a latch, a lock, a plug, a washer, a nut, a band and any other type of seal that may prevent moisture from entering the connector 10.

It will be further understood that the cap 16 may any type of cap that compresses the connector 10 and included fastener 11 onto a coaxial cable, wherein exemplary cap elements may be, but are not limited to a compression cap, a nut, a bolt, a screw, a wedge, a clamp, a latch, a lock and any other member that may be used to attach the connector to the cable. Additionally, the slot of the fastener member 12 may also be a protrusion, a nib, an aperture, a channel, a cut, a groove, a hole, a niche, a recess, a slit and/or a socket or other like surface feature.

Figure 3:
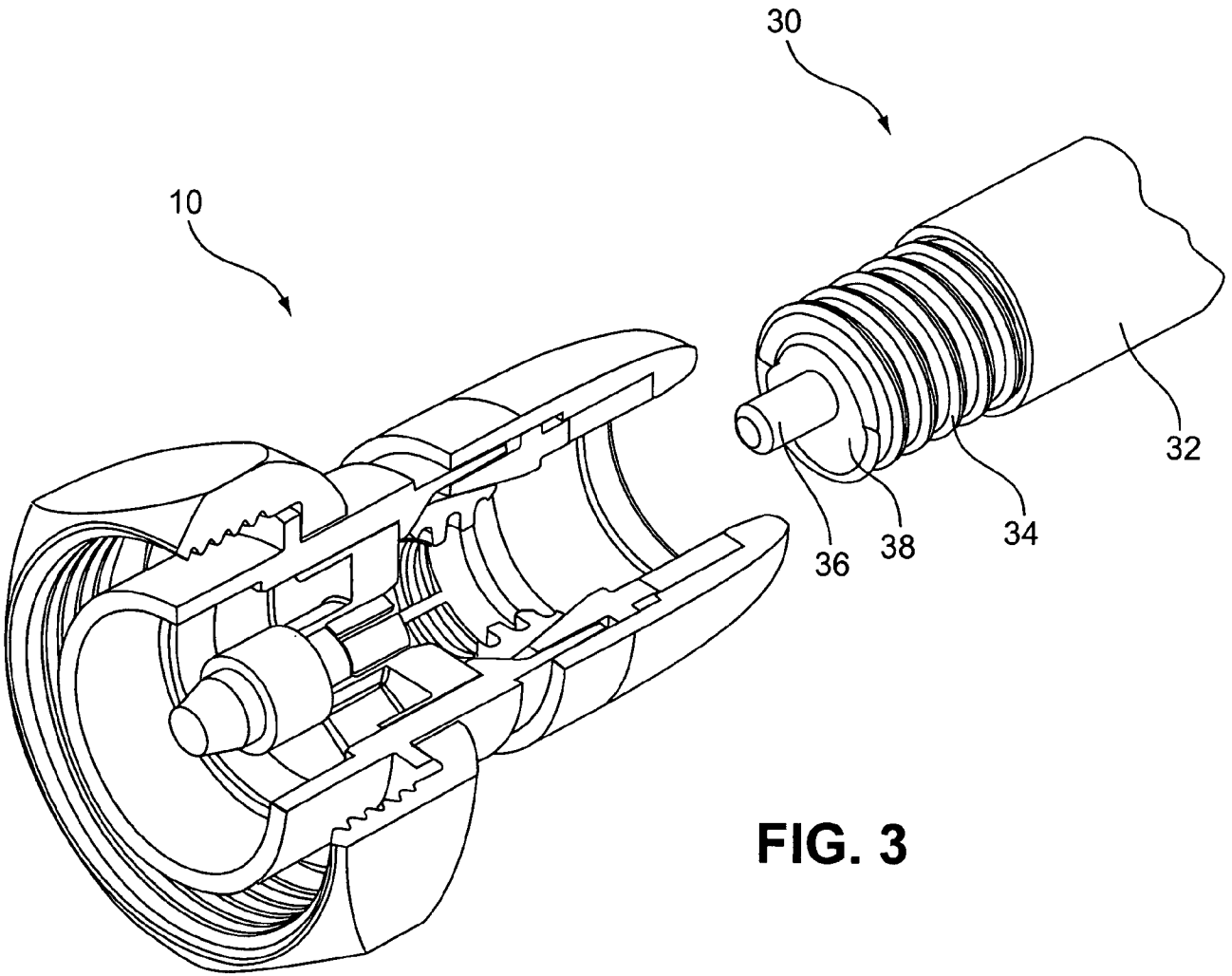
FIG. 3 depicts a perspective view with a partial section of a connector and a perspective view of a spiral corrugated coaxial cable, in accordance with the present invention.

With additional reference to the drawings, FIG. 3 depicts a cut-away perspective view of an embodiment of the connector 10 and an embodiment of a spiral corrugated coaxial cable 30. The cable 30 may comprise an outer protective jacket 32, spiral corrugation 34 that may form an outer conductor, an inner conductor 36 and a foam dielectric 38 to insulate the inner conductor 36 from the corrugation 34. Particular embodiments of the cable 30 may be, but are not limited to, a 50 ohm "superflex" cable or a 75 ohm "coral" cable manufactured by Andrew Corporation (www.andrew.com). The connector 10 is configured to completely receive the corrugation 34 and the inner conductor 36 of the cable 30.

Figure 4:
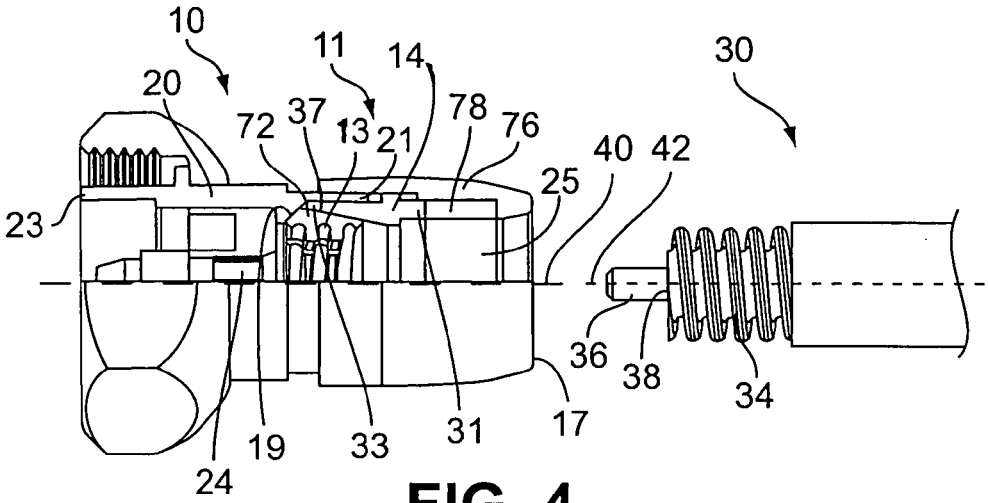
FIG. 4 depicts a side view of a connector in a position to insert a coaxial cable, in accordance with the present invention.
Figure 5:
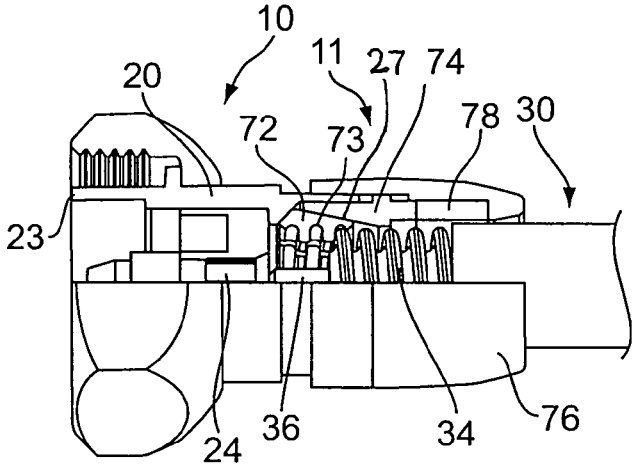
FIG. 5 depicts a side view with a partial section of a connector in an opened position with a coaxial cable partially inserted within the connector, in accordance with the present invention.
Figure 6:
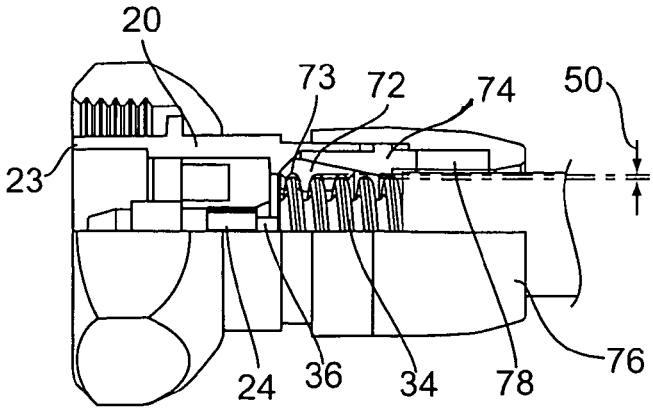
FIG. 6 depicts a side view with a partial section of a connector in an opened position with a coaxial cable fully inserted within the connector.

With further reference to the drawings, FIGS. 4–6 depict side views of a connector 10 for coupling an end of a coaxial cable 30, the coaxial cable 30 having a center conductor 36 surrounded by a dielectric 38, the dielectric 38 being surrounded by a spiral corrugated thin-walled conductor 34. The connector 10 may comprise a connector body 20, having a first end 21 and a second opposing end 23; and fastener 11, which may be operatively attached to the connector body 20, said fastener 11 having a first end 17 and a second opposing end 19. The fastener 11 may have a central passageway 25 defined between the fastener first end 17 and the fastener second end 19, the central passageway 25 having an internal surface for engaging a coaxial cable, such as, by way of example, grooved surface 13 of fastener member 12, dimensioned for closely receiving the spiral corrugated thin-walled conductor 34. Moreover, the central passageway 25 may compress inwardly to decrease the volume of the central passageway 25 when moved toward the second end 23 (or away from the first end 21) of the connector body causing a minor distortion of the spiral corrugated thin-walled conductor 34 of the coaxial cable 30 as said fastener 11 is advanced into secure communication with the connector body 20 by moving toward the second end of said connector body 23. A minor distortion is one that will provide an electrical connection, yet will not substantially damage the thin-walled conductor 34. This compression of the central passageway may be accomplished by reducing the internal radius of a portion of the fastener 11, such as, by way of example, compressing the fastener member 12. While this connection is made, the inner conductor 36 may be brought into contact with the center conductor contact 24 of the connector 10, thereby providing electrical functionality of the cable and facilitate electrical connection to a peripheral device.

Additionally, the fastener 11 may include a ramped surface 27, such as for example, a portion of the radially exterior surface of fastener 12. Furthermore, the fastener 11 may further comprise a compression member 14, operatively attached to the connector body 20, the compression member 14 having a first end 31 and a second opposing end 33, said compression member 14 having a central passageway 25 defined between the compression member first end 31 and the compression member second end 33, said central passageway 25 having a ramped surface 37, such as for example, a portion of the radially interior surface of the compression member 14, that may be dimensioned for closely receiving the ramped surface 27 of the fastener member 12. The ramped surface 37 of the compression member 14 engages the ramped surface 27 of the fastener member 11 actuating the compression of the central passageway 25 of the fastener member 12 when the compression member 14 is moved toward the second end 23 of the connector body 20.

The fastener member 12 may further comprise at least one slot 15, as shown in FIG. 1, extending partially from the fastener member first end 17 to the fastener member second end 19 and from an outside of the fastener member 27 to the central passageway 25, wherein the slot 15 allows compression of the central passageway 25. The fastener member 12 may further comprise an elastomeric grommet 18, operatively attached to the connector body 20, wherein the grommet 18 is configured to expand radially when moved toward the second end 23 of the connector body 20. The grommet 18 may be configured to seal the connector 10 to substantially prevent moisture entry into the connector 10, provide additional grip on the coaxial cable 30 and provide strain relief and may be formed of conductive and/or non-conductive materials.

Referring further to the drawings and FIGS. 4–6, a particular embodiment of a connector 10 is also shown. The connector 10 for use with spiral corrugated coaxial cable 30 comprises a connector body 20, having a first end 21 and a second end 23, a compression cap 76 received on the first end 21 of the connector body 20, wherein the compression cap 76 is moveable axially along the body 20 and a clamp 72 received between the connector body 20 and the compression cap 76, wherein the clamp 72 includes an internal spiral 73 complimentary to a spiral configuration of a coaxial cable 30 with a spiral corrugated conductor 34, wherein, as the compression cap 76 advances axially onto the connector body 20 and engages the clamp 72, the internal spiral 73 compresses onto the spiral corrugated conductor 34 of the coaxial cable 30.

The connector 10 may further comprise a compression ramp member 74 received between the connector body 20 and the compression cap 76, wherein at least one of the compression ramp member 74 and the clamp 72 has a frustoconical shape being engaged by the other of the ramp member 74 and the clamp 72 and at least one of the compression ramp member 74 and the clamp 72 is axially moveable relative to the other of the clamp 72 and the ramp member 74.

According to particular embodiments of the present invention, the connector 10 may further comprise an elastomeric grommet 18 received between the compression cap 76 and the compression ramp member 74, and is configured to expand radially while being compressed axially to seal the connector 10 to substantially prevent moisture entry into the connector 10. Further, other embodiments may have an internal spiral 73 of the clamp 72 that is dimensioned to have sufficient clearance to thread onto the spiral corrugated conductor 34 of the coaxial cable 30 while fitting close enough to the spiral corrugated conductor 34 that when the internal spiral 73 compresses, the internal spiral 73 is in uniform, supportive radial contact with the spiral corrugated conductor 34. Further still, the connector 10 further comprises at least one slot 15, wherein the slot allows the internal spiral 73 to move radially inward thereby reducing the radius of the internal spiral 73.

For example and without limitation, FIG. 4 depicts the connector 10, wherein the connector 10 may comprise a connector body 20 and a fastener 11. The fastener 11 may include a clamp 72, a compression ramp member 74 and a compression cap 76 positioned in such a manner that the axis of the connector 40 and the axis of the cable 42 are substantially aligned with the compression cap 76 of the connector 10 in position to receive the cable 30. Referring now to FIG. 5, the internal spiral 73 of the clamp 72 of the connector 10 may be configured to compliment the corrugation 34 of the cable 30. This complimentary association between the internal spiral 73 and the corrugation 34 allows the clamp 72 to thread onto the corrugation 34.

Referring now to FIG. 6, when the cable 30 is fully inserted within the connector 10, there may be a clearance 50 between the internal spiral 73 and the corrugation 34, wherein the clearance may be a close fitting clearance approximately matching the profile of the corrugation 34. It will be understood by those of ordinary skill in the art that internal spiral 73 of the clamp 72 is of a size and shape to have sufficient clearance 50 to thread onto the corrugation 34 of the coaxial cable 30 while fitting close enough to the corrugation that when the clamp 72 is in a clamped position the clamp 72 is in uniform, supportive radial contact with the corrugation of the coaxial cable.

Once the cable 30 is fully inserted within the connector 10, the clamp 72 may be moved radially from an opened position into a clamped position. This occurs as the compression ramp member 74 engages the clamp 72. The frustoconical shape of either the compression ramp member 74, the clamp 72 or both provide for uniform deformation and/or movement of the clamp 72 radially inward toward the corrugation 34. The clamp 72 may comprise a plurality of slots (not shown) that enable the deformation of the clamp 72 by providing room for the clamp's radius to be reduced. While only one slot may be needed, the particular embodiments with a plurality of slots may require less force to deform the clamp 72 and may also provide greater contact between the clamp 72 and the corrugation 34.

Figure 7:
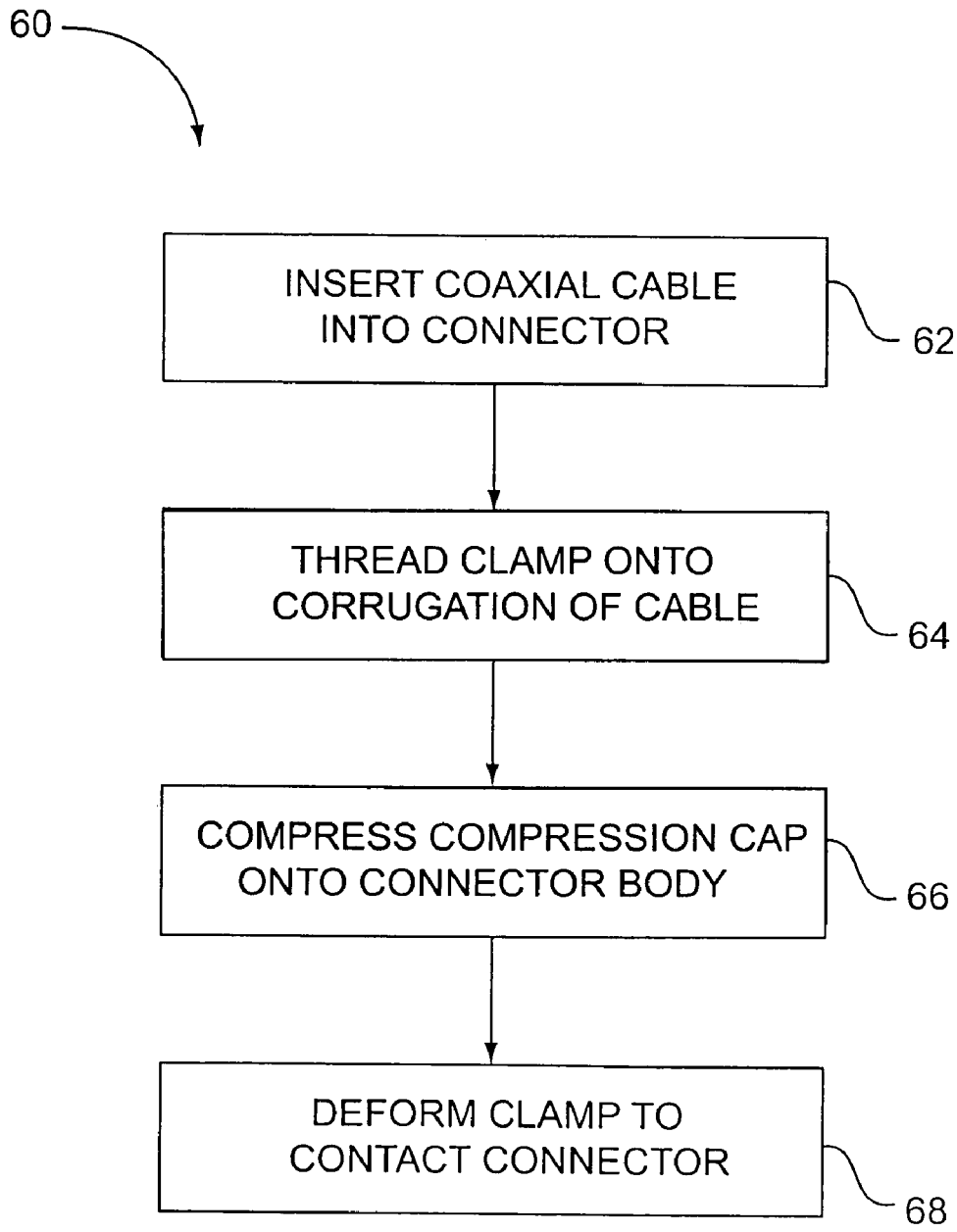
FIG. 7 depicts a flow chart of a method of use of a connector, in accordance with the present invention.

With continued reference to the drawings, FIG. 7 depicts a flow chart of a method of attaching a connector to a spiral corrugated cable. The method 60 may be accomplished through the steps of inserting a coaxial cable with spiral corrugation into a connector (Step 62), threading a clamp fastener member of the connector onto the corrugation of the coaxial cable (Step 64), compressing a compression cap of the connector onto a connector body of the connector (Step 66), and deforming the clamp fastener member uniformly and radially inward to contact an outer surface of the corrugation (Step 68). Step 66 may further comprise the step of compressing a compression ramp member between the clamp fastener member and the connector body, wherein the compressing of the compression ramp further comprises engaging the clamp fastener member. Step 66 may further still comprise the step of compressing an elastomeric grommet of the connector axially and expanding the grommet radially, wherein the compressing an elastomeric grommet further comprises sealing the connector from substantial moisture entry. Step 68 may further comprise the step of providing uniform pressure and contact on the corrugation without distorting or breaking a conductor of the cable.

According to particular embodiments of the present invention, Step 66 may be accomplished by use of a special force applying tool. It will be understood that while a special force applying tool may be used, in other particular embodiment of the present invention, such as, but not limited to, connectors with compression caps and connector bodies that thread together, other tools such as, but not limited to a wrench or fingers may be used in place of the special force applying tool.

It will also be understood that the steps and determinations of method 50 were shown in the order depicted in FIG. 7 as an exemplary method according to an embodiment of the invention, and are not limited to any particular order. The steps of method 60 may be performed in any order, so long as proper connection between the connector and cable is accomplished.

While the present invention has been described and illustrated herein with respect to preferred embodiments, it should be apparent that various modifications, adaptations and variations may be made utilizing the teachings of the present disclosure without departing from the scope of the invention and are intended to be within the scope of the present invention. In light of the foregoing, it will now be appreciated by those skilled in art that modifications may be made to the disclosed embodiments without departing from the spirit and scope of the invention as defined by the appended claims.

I claim:

1. A connector for coupling an end of a coaxial cable, the coaxial cable having a center conductor surrounded by a dielectric, the dielectric being surrounded by a spiral corrugated thin-walled conductor, said connector comprising:

a. a connector body, having a first end and a second opposing end;

b. a fastener member, axially positioned proximate the first end of the connector body, said fastener member having a central passageway, said central passageway having a grooved surface dimensioned for closely receiving the spiral corrugated thin-walled conductor; and c. a compression member, operable with a compression cap, said compression cap slidably mounted on an outer surface of said connector body, wherein axial advancement of the compression member by the compression cap toward the second end of said connector body compresses the central passageway of the fastener member inwardly causing the fastener member to engage the spiral corrugated thin-walled conductor of the coaxial cable.

2. The connector of claim 1, further comprising an elastomeric grommet, operatively attached to the connector body, wherein the grommet is configured to expand radially when moved toward the second end of the connector body.

3. The connector of claim 1, wherein the connector is at least one of a DIN male connector, a DIN female connector, a TNC male connector, a TNC female connector, an N male connector, an N female connector, an F male connector, an F female connector, an HN male connector, an HN female connector, an LC male connector, an LC female connector, an LT male connector, an LT female connector, an SMA male connector, an SMA female connector, a UHF male connector, and a UHF female connector.

4. The connector of claim 1, wherein an outside of the fastener member includes a ramped surface.

5. The connector of claim 4, wherein said compression member having a central passageway defined between a first end and opposing second end of the compression member, said central passageway having a ramped surface dimensioned for closely engaging the ramped surface of the fastener member.

6. The connector of claim 5, wherein the ramped surface of the compression member and the ramped surface of the fastener member facilitate compression of the central passageway of the fastener member when the compression member is moved toward the second end of the connector body.

7. The connector of claim 1, wherein the fastener member further comprises at least one slot extending partially from a fastener member first end to a fastener member second end and from an outside of the fastener member to the central passageway, wherein the slot allows compression of the central passageway.

8. The connector of claim 7, wherein the grommet is configured to:

seal the connector to substantially prevent moisture entry into the connector;

provide additional grip on the coaxial cable; and provide strain relief.

9. A connector for use with coaxial cable having spiral corrugated conductor, the connector comprising:

a connector body, having a first end and a second end;

a compression cap, slidably mounted on an outer surface of said connector body, wherein said compression cap is configured to axially slidably engage the first end of the connector body; and a clamp received between the connector body and the compression cap, wherein the clamp includes:

an internal spiral complimentary to the spiral corrugated conductor of the coaxial cable, wherein, axial advancement of the compression cap onto the connector body facilitates secure contact between the clamp and the spiral corrugated conductor of the coaxial cable.

10. The connector of claim 9, wherein the internal spiral of the clamp is dimensioned to have sufficient clearance to thread onto the spiral corrugated conductor of the coaxial cable while fitting close enough to the spiral corrugated conductor that when the internal spiral compresses, the internal spiral is in uniform, supportive radial contact with the spiral corrugated conductor.

11. The connector of claim 9, further comprising at least one slot, wherein the slot allows the internal spiral to move radially inward thereby reducing the radius of the internal spiral.

12. The connector of claim 9, wherein the connector is at least one of a DIN male connector, a DIN female connector, a TNC male connector, a TNC female connector, an N male connector, an N female connector, an F male connector, an F female connector, an HN male connector, an HN female connector, an LC male connector, an LC female connector, an LT male connector, an LT female connector, an SMA male connector, an SMA female connector, a UHF male connector, and a UHF female connector.

13. The connector of claim 9, further comprising a compression ramp member received between the connector body and the compression cap, wherein:

at least one of the compression ramp member and the clamp has a frustoconical shape being engaged by the other of the ramp member and the clamp; and at least one of the compression ramp member and the clamp is axially moveable relative to the other of the clamp and the ramp member.

14. The connector of claim 13, further comprising an elastomeric grommet received between the compression cap and the compression ramp member, and is configured to expand radially while being compressed axially to seal the connector to substantially prevent moisture entry into the connector.

15. A method of attaching a connector to a spiral corrugated coaxial cable; the method comprising:

inserting a coaxial cable with spiral corrugation into a connector;

threading a clamp of the connector onto the corrugation of the coaxial cable;

compressing a compression cap of the connector onto an outer surface of a connector body of the connector; and deforming the clamp uniformly and radially inward to electrically contact an outer surface of the corrugation.

16. The method of claim 15, wherein the deforming the clamp further comprises providing uniform pressure and contact on the corrugation without distorting or breaking a conductor of the cable.

17. The method of claim 15, wherein the compressing a compression cap of the connector further comprises compressing a compression ramp member between the clamp and the connector body.

18. The method of claim 17, wherein the compressing of the compression ramp member further comprises engaging the clamp.

19. The method of claim 15, wherein the compressing a compression cap of the connector further comprises compressing an elastomeric grommet of the connector axially and expanding the grommet radially.

20. The method of claim 19, wherein the compressing an elastomeric grommet further comprises sealing the connector from substantial moisture entry.

* * * * *